US008282102B2

(12) United States Patent
Garnier Letourneau

(10) Patent No.: US 8,282,102 B2
(45) Date of Patent: Oct. 9, 2012

(54) FISHING GAME

(76) Inventor: Samuel Garnier Letourneau, Ste-Catherine-Jacques-Cartier (CA)

( * ) Notice: Subject to any disclaimer, the term of this patent is extended or adjusted under 35 U.S.C. 154(b) by 0 days.

(21) Appl. No.: 13/158,401

(22) Filed: Jun. 11, 2011

(65) Prior Publication Data

US 2012/0032397 A1 Feb. 9, 2012

(30) Foreign Application Priority Data

Aug. 6, 2010 (GB) ..... 1013276.9

(51) Int. Cl.
*A63F 3/00* (2006.01)

(52) U.S. Cl. ..... 273/239; 273/277; 273/287

(58) Field of Classification Search ..... 273/239, 273/277, 287
See application file for complete search history.

(56) References Cited

U.S. PATENT DOCUMENTS

| | | | | |
|---|---|---|---|---|
| 2,557,789 | A | 6/1951 | Lamka | |
| 2,747,872 | A | 5/1956 | Harvey | |
| 3,409,302 | A | 11/1968 | Harrison | |
| 3,811,681 | A | 5/1974 | Sprouse et al. | |
| 3,844,567 | A | 10/1974 | Marker | |
| 3,857,562 | A * | 12/1974 | Rardon et al. | 473/107 |

* cited by examiner

*Primary Examiner* — Vishu K Mendiratta

(57) ABSTRACT

A board game based on the sport of fishing having a board surface having various features and players are given special privileges in order to catch fish according to a set of rules and steps.

4 Claims, 5 Drawing Sheets

FISHING GAME

FIELD OF THE INVENTION

The present invention relates generally to games but more particularly to a game related to the sport of fishing.

BACKGROUND OF THE INVENTION

There are many types of tabletop games but few, if any, are related to fishing.

SUMMARY OF THE INVENTION

In view of the foregoing disadvantages inherent in the known devices now present in the prior art, the present invention, which will be described subsequently in greater detail, is to provide objects and advantages which are:

To provide for a new type of board game.

To attain these ends, the present invention generally comprises a series of maps showing lakes and black slates; 6 fishermen slates; 21 fish slates; experience level cards; 30 skills cards; 6 playing fishing rods; 550 metal beads; and 6 pawns. The game consists in creating a fisherman's profile based on the cards chosen as well as the lake and black slate chosen.

The fishing game apparatus has a game board having a body including a top surface adapted to receive a removable surface pattern plate member, and including a grid pattern of equally spaced rectilinear lines of holes therethrough, a hollow core adapted to receive a removable underlying pattern plate member, a slit on one side thereof adapted to allow the underlying pattern plate member to be slid therethrough, and at least one slot on a side adjacent to the one side and adapted to allow the passage of ferrous beads therethrough into the hollow core.

The removable surface pattern plate member having a predetermined pattern of holes therethrough aligning with predetermined holes of the top surface of the body. The underlying pattern plate member having a predetermined pattern of holes that is different than the pattern of holes of the removable surface pattern plate member, such that only a set number of holes of the top surface, the removable surface pattern plate member, and the underlying pattern plate member align with one another. A predetermined number of ferrous beads sized and adapted to pass through the at least one slit and each respective hole of the surface and plate members, and reside in respective holes of the underlying pattern plate member; and a fishing pole member including a magnetized tip adapted to pass through each respective hole of the surface and plate members, and adapted to attach to one of the plurality of ferrous beads at a time, when respective holes are aligned and a ferrous bead resides therein, and pull them through and out of the respective holes and out from the game board body.

The fishing game apparatus has a plurality of surface pattern plate members and underlying pattern plate members having differing patterns, such that any one of the surface pattern plate members and one of the underlying pattern plate members are chosen and placed upon and within the game board, thereby changing the location of respectively aligning holes, and thereby changing the location of where the ferrous beads can be pulled out by the fishing pole member.

The fishing game apparatus has at least one slot on each opposite side of the game board.

The fishing game apparatus has three slots on each opposite side of the game board.

The fishing game apparatus has the game board body including adjustable feet on a bottom surface thereof.

A method of playing a fishing game including the steps of:

a.) providing and apparatus comprising a game board having a body including a top surface adapted to receive a removable surface pattern plate member, and including a grid pattern of equally spaced rectilinear lines of holes therethrough, a hollow core adapted to receive a removable underlying pattern plate member, a slit on one side thereof adapted to allow the underlying pattern plate member to be slid therethrough, and at least one slot on a side adjacent to the one side and adapted to allow the passage of ferrous beads therethrough into the hollow core.

b.) providing a removable surface pattern plate member having a predetermined pattern of holes therethrough aligning with predetermined holes of the top surface of the body.

c.) providing an underlying pattern plate member having a predetermined pattern of holes that is different than the pattern of holes of the removable surface pattern plate member, such that only a set number of holes of the top surface, the removable surface pattern plate member, and the underlying pattern plate member align with one another.

d.) providing a predetermined number of ferrous beads sized and adapted to pass through the at least one slit and each respective hole of the surface and plate members, and reside in respective holes of the underlying pattern plate member.

e.) providing a fishing pole member including a magnetized tip adapted to pass through each respective hole of the surface and plate members, and adapted to attach to one of the plurality of ferrous beads at a time, when respective holes are aligned and a ferrous bead resides therein, and pull them through and out of the respective holes and out from the game board body.

f.) allowing one player to place the fishing pole member within one chosen hole.

g.) if the fishing pole member comes in contact with one of the ferrous beads, the player removes the bead through the aligned holes, out of the game board, and keeps for scoring purposes.

h.) each player being allowed a number of fishing attempts.

i.) a winner being decided by the number of beads successfully removed from the game board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
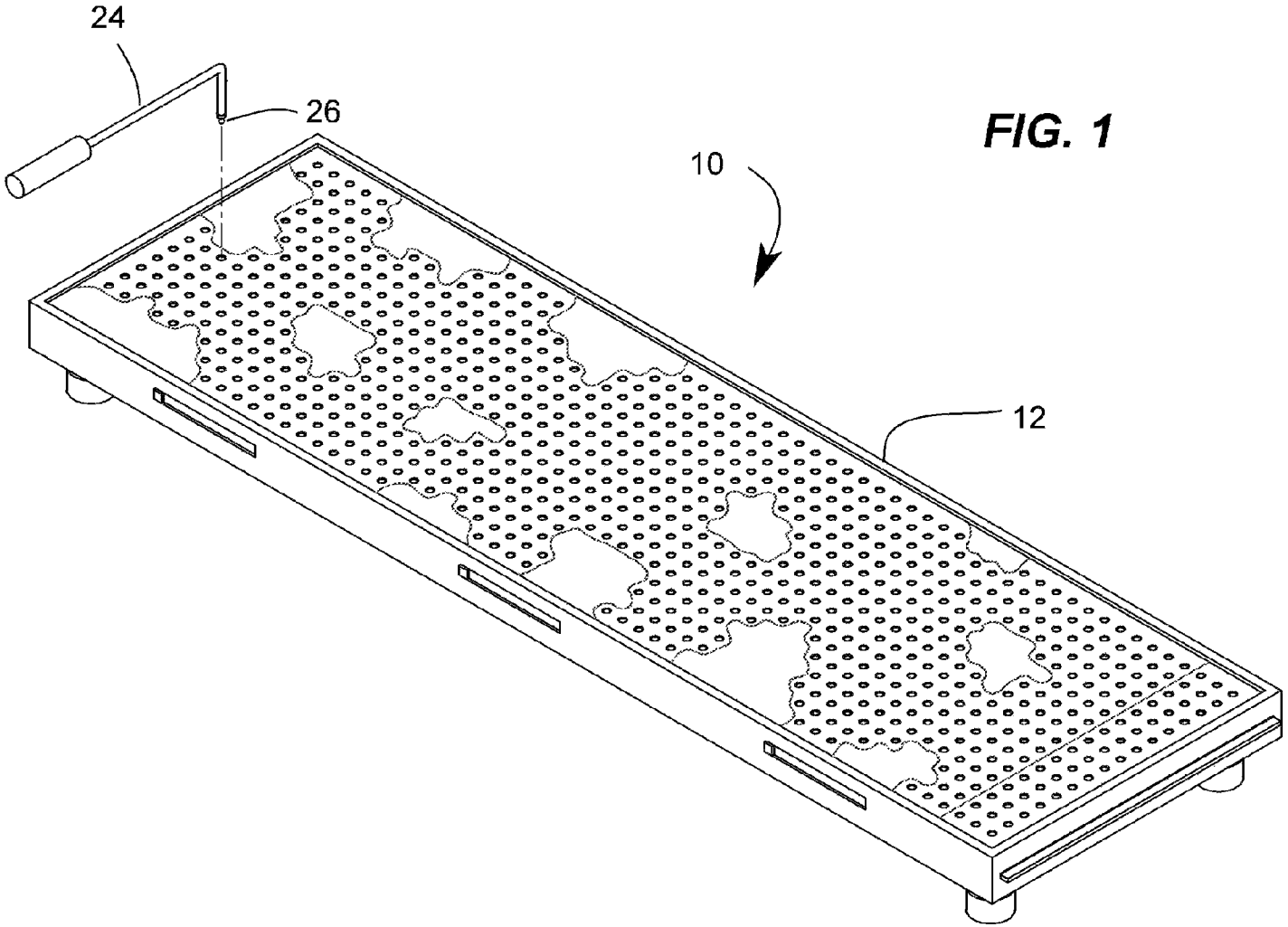
FIG. 1 Isometric view of the board game.
Figure 2:
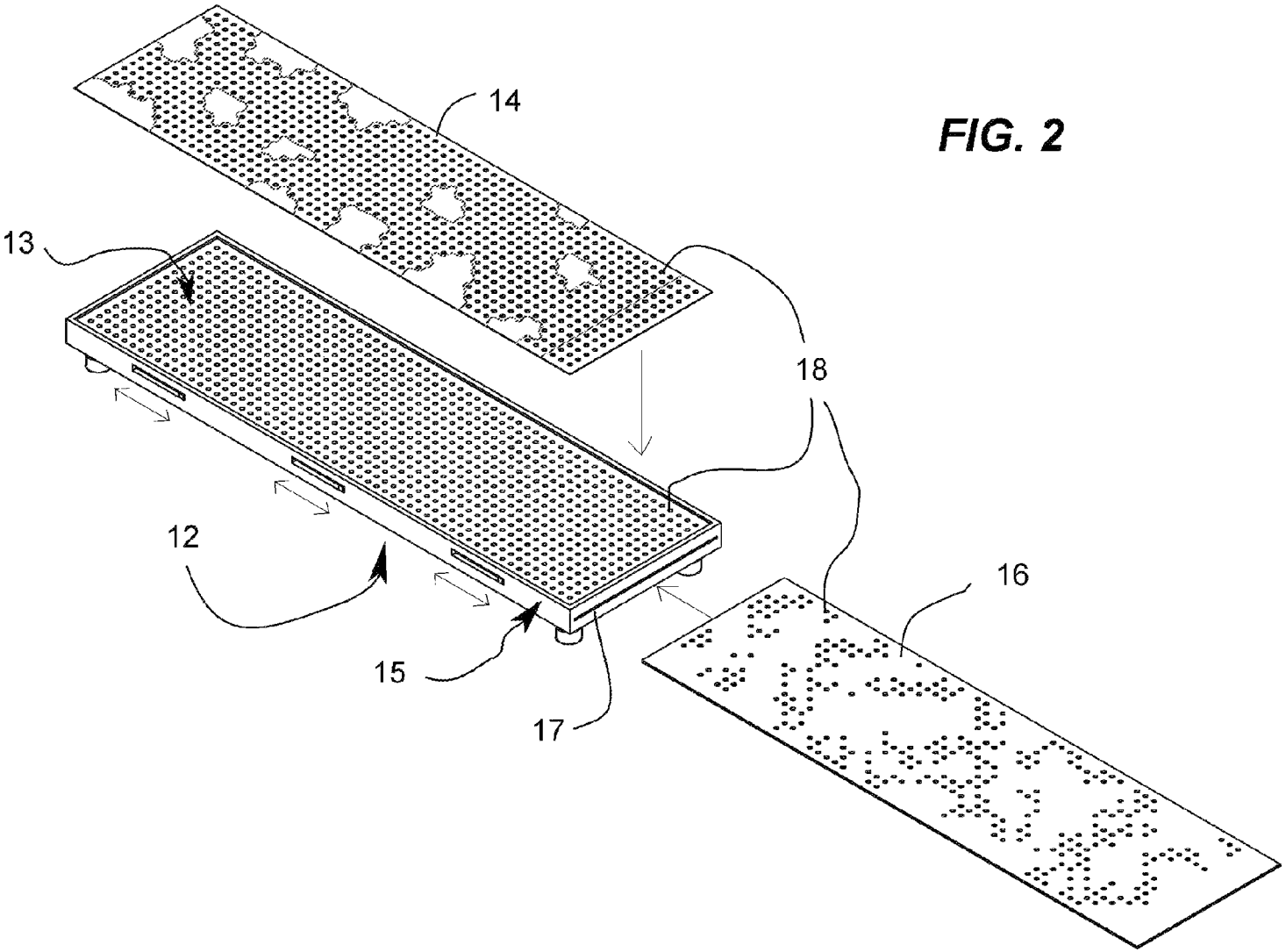
FIG. 2 Exploded view of the components of the board elements.
Figure 3:
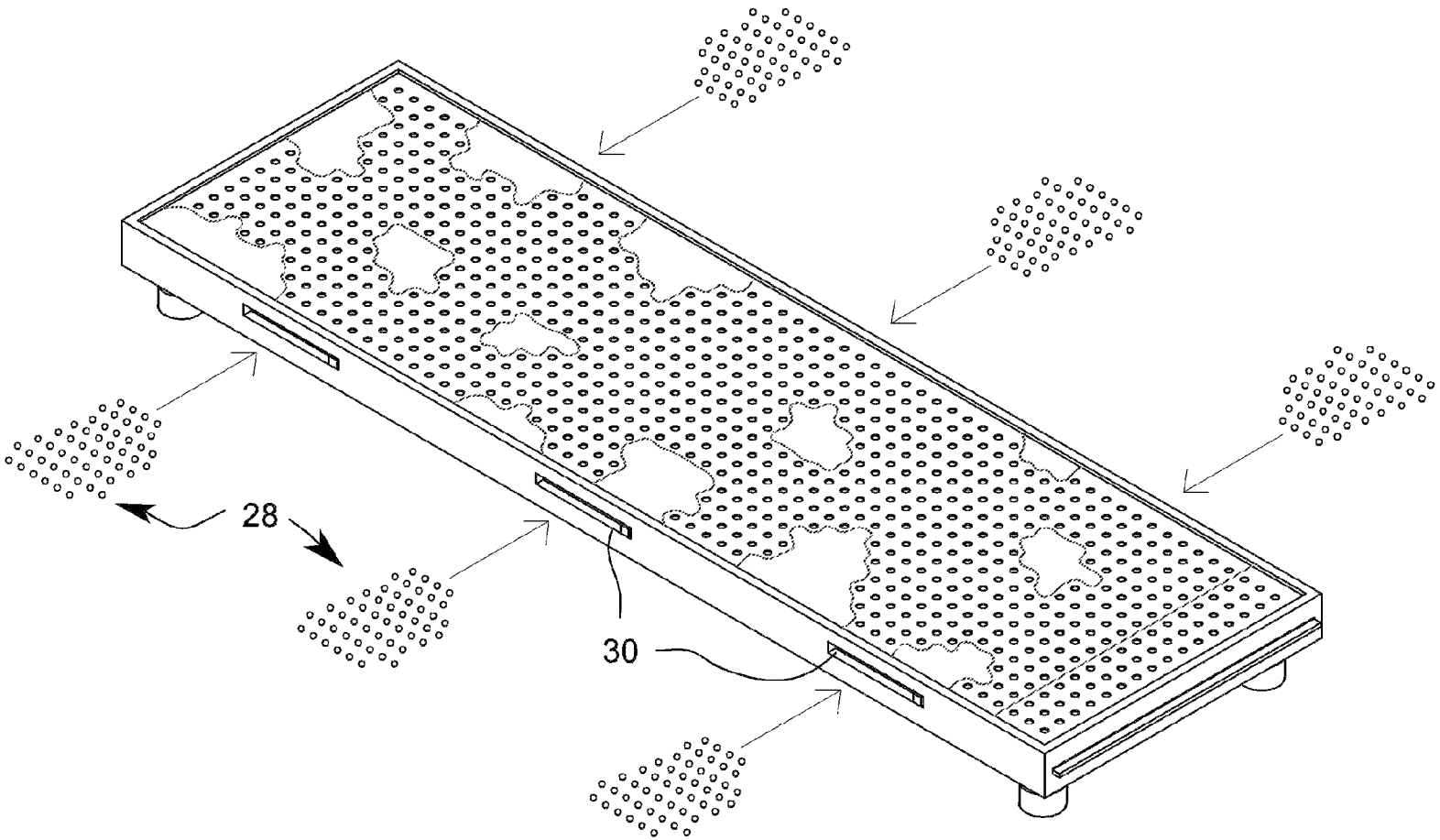
FIG. 3 Isometric view of the board game showing where the steel balls are inserted.
Figure 4A:
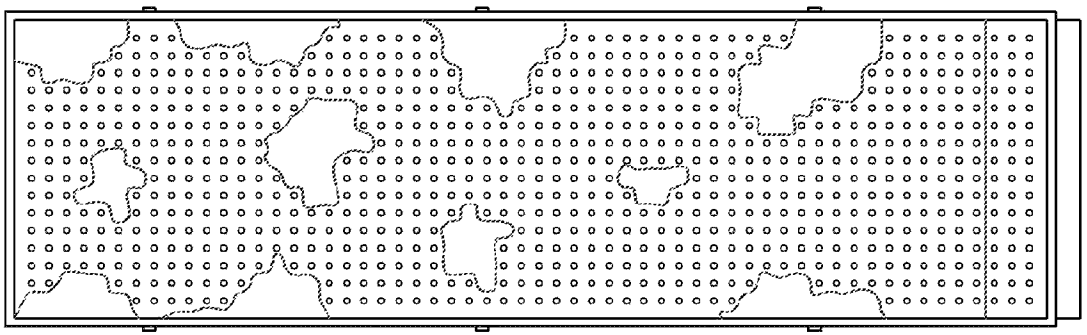
FIG. 4*a-c* Top, front and side views, respectively, of the game.
Figure 4B:
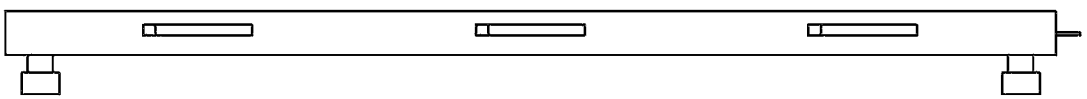
Figure 4C:
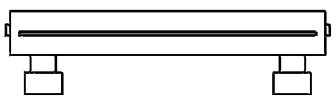

A fishing game (10) has a board body (12) comprised of a top surface (13) configured for receiving a removable surface pattern plate (14) laid upon it and a hollow core (15) configured so as to receive a removable underlying pattern plate (16) slid through a slit (17). The top surface (13) has a grid pattern of equally spaced apart rectilinear lines of holes (18). The surface pattern plate (14) is a generally flat rectangular surface having smooth patterns defined by the holes (18) covering other parts of the surface pattern plate (14).

The underlying pattern plate (16) is similar in shape and size to the surface pattern plate (14) but presents patterns that are different than those of the surface pattern plate (14). All three layers, that is the rectilinear lines of holes (18) of the top surface (13), the surface pattern plate (14) and the removable underlying pattern plate (16), have their holes (18) aligned so that a fishing rod (24) having a magnetized tip (26) can have its tip (26) pass through all three layers of holes (18).

Figures 5A, 5B:
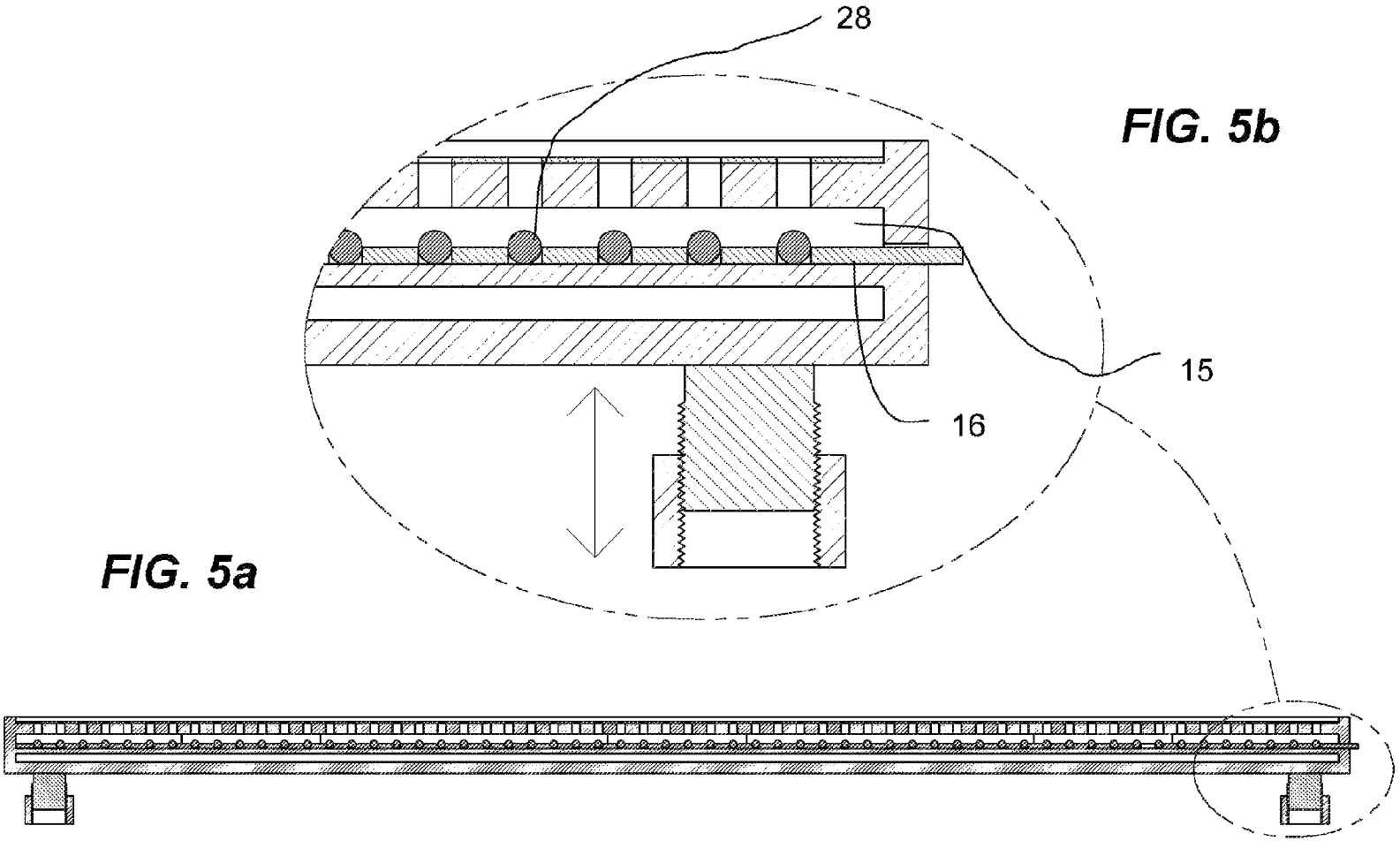
FIG. 5*a-b* Cutaway front view and detail, respectively of the board.

A plurality of ferrous beads (28) are inserted through slots (30) located on the side of the board body (12) and into the hollow core (15) so that they fall into the holes of the underlying pattern plate (16), as seen in FIG. 5*b*.

The game consists in trying to attract beads (28) by way of the magnetized tip (26) when the tip can touch a bead (28) located in a hole (18) of the underlying pattern plate (16). This is not always the case as sometimes the underlying layer pattern plate (16) does not have holes (18) at certain locations. By way of trial and error, the players can "fish" the beads (28).

Alternatively, the beads (28) can be made of a non-ferrous material such as plastic, for example, in which case, the magnetized tip (26) would be an adhesive tip, which would perform the same task and be within the scope of this invention.

There are many sets of removable surface pattern plate (14) and removable underlying pattern plate (16) which can be mixed so as to constantly change the patterns.

Adjustable feet (32) located underneath the board body (12) allow for the leveling of the top surface (13).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A fishing game apparatus comprising:

a game board having a body including a top surface adapted to receive a removable surface pattern plate member, and including a grid pattern of equally spaced rectilinear lines of holes therethrough;

a hollow core adapted to receive a removable underlying pattern plate member, a slit on one side thereof adapted to allow said underlying pattern plate member to be slid therethrough;

at least one slot on a side adjacent to said one side and adapted to allow the passage of ferrous beads therethrough into said hollow core;

said removable surface pattern plate member having a predetermined pattern of holes therethrough aligning with predetermined holes of said top surface of said body;

said underlying pattern plate member having a predetermined pattern of holes that is different than said pattern of holes of said removable surface pattern plate member, such that only a set number of holes of said top surface, said removable surface pattern plate member, and said underlying pattern plate member align with one another;

a predetermined number of ferrous beads sized and adapted to pass through said at least one slit and each respective hole of said surface and plate members, and reside in respective holes of said underlying pattern plate member;

a fishing pole member including a magnetized tip adapted to pass through each respective hole of said surface and plate members, and adapted to attach to one of said plurality of ferrous beads at a time, when respective holes are aligned and a ferrous bead resides therein, and pull them through and out of said respective holes and out from said game board body;

a plurality of surface pattern plate members and underlying pattern plate members having differing patterns, such that any one of said surface pattern plate members and one of said underlying pattern plate members are chosen and placed upon and within said game board, thereby changing the location of respectively aligning holes, and thereby changing the location of where said ferrous beads can be pulled out by said fishing pole member.

2. The fishing game apparatus of claim 1, including at least one slot on each opposite side of said game board.

3. The fishing game apparatus of claim 2, including three slots on each opposite side of said game board.

4. The fishing game apparatus of claim 1, wherein said game board body includes adjustable feet on a bottom surface thereof.

* * * * *